United States Patent [19]

Cavalli

[11] Patent Number: 4,692,588

[45] Date of Patent: Sep. 8, 1987

[54] STEAM GENERATING APPARATUS FOR DIFFERENT HOUSEHOLD APPLICATION OUTLETS

[76] Inventor: Alfredo Cavalli, Via Galileo Galilei, 9, Pessano con Bornago (Milano-Italy), Italy

[21] Appl. No.: 720,403

[22] Filed: Apr. 5, 1985

[30] Foreign Application Priority Data

Apr. 6, 1984 [IT] Italy ..... 21467/84[U]

[51] Int. Cl.[4] ..... D06F 75/08

[52] U.S. Cl. ..... 219/245; 38/75

[58] Field of Search ..... 219/245, 271, 275, 259; 38/77.6, 77.3, 79, 142, 69, 75

[56] References Cited

U.S. PATENT DOCUMENTS 2,713,225 7/1955 Wolcott ..... 38/75
2,962,576 9/1959 Miller ..... 219/245

FOREIGN PATENT DOCUMENTS 212631 4/1940 Switzerland ..... 38/77
764218 12/1956 United Kingdom ..... 38/77.3

*Primary Examiner*—Nicholas P. Godici
*Assistant Examiner*—Karen Skillman
*Attorney, Agent, or Firm*—Fleit, Jacobson, Cohn & Price

[57] ABSTRACT

An apparatus for generating steam at domestic level comprises a steam jet iron having an ironing plate formed with steam delivery orifices, a steam manifold removably associated with the ironing plate at the steam delivery orifices, and a delivery conduit hydraulically connected to the steam manifold.

10 Claims, 3 Drawing Figures

STEAM GENERATING APPARATUS FOR DIFFERENT HOUSEHOLD APPLICATION OUTLETS

BACKGROUND OF THE INVENTION

This invention relates to a steam generating apparatus for different household application outlets.

The need is particularly felt for small steam generating apparatus for use in cleaning operations, for example.

Currently available on the market are steam generators for domestic use which are generally employed in the home to operate ironing, cleaning, and other small-size appliances. Such steam generators essentially comprise a small electrically heated boiler adapted for connection to one or more outlets through a suitable piping system and possible cut-off valving means.

The boiler contains a relatively large mass of water which is heated indiscriminately, irrespective of the actual demand. Thus, steam generators of that type are apt to imply a high consumption of electric power.

A further disadvantage of more than a purely economical character affecting such prior steam generators is that they must be fitted with appropriate safeguarding means or devices. Indeed, they represent a potential risk for the user due to the presence of the heated water-pressurized steam combination within the boiler in operation.

SUMMARY OF THE INVENTION

The problem underlying this invention is that of providing an apparatus which can generate steam in the amounts and with the procedures required for delivery to a range of domestic outlets, and which has such constructional and functional features as to obviate all of the problems affecting the cited prior apparatus.

This problem is solved by a steam generating apparatus which, according to the invention, is characterized in that it comprises a steam jet iron having an ironing plate formed with steam delivery orifices, a steam manifold removably associated with said ironing plate at said orifices, a sealing means interposed between said steam manifold and said ironing plate, and a delivery conduit hydraulically connected to said steam manifold.

BRIEF DESCRIPTION OF THE DRAWNGS

The invention features and advantages will be more clearly understood from the following detailed description of a preferred but not exclusive embodiment of an apparatus according to the invention, in conjunction with the accompanying illustrative but not limitative drawings, where:

DESCRIPTION OF THE PREFERRED EMBODIMENT

Figure 1:
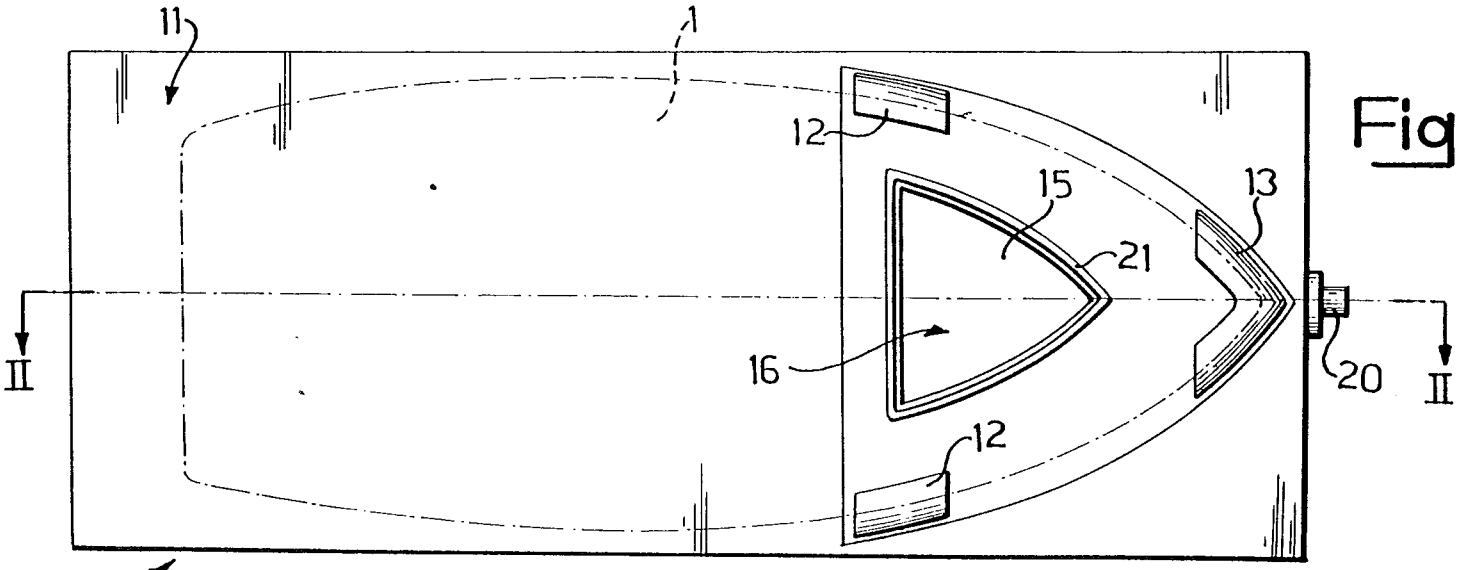
FIG. 1 is a top plan view of the inventive apparatus, with a steam jet iron being outlined schematically by a dash-and-dot line.
Figure 2:
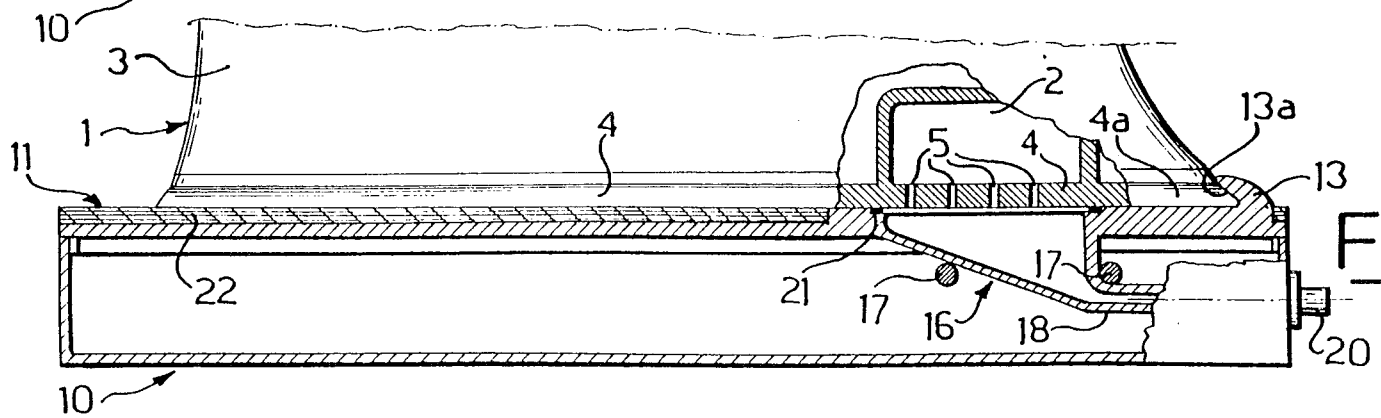
FIG. 2 is a cross-sectional view taken along the line II—II of FIG. 1 and showing the steam jet iron in schematic form.
Figure 3:
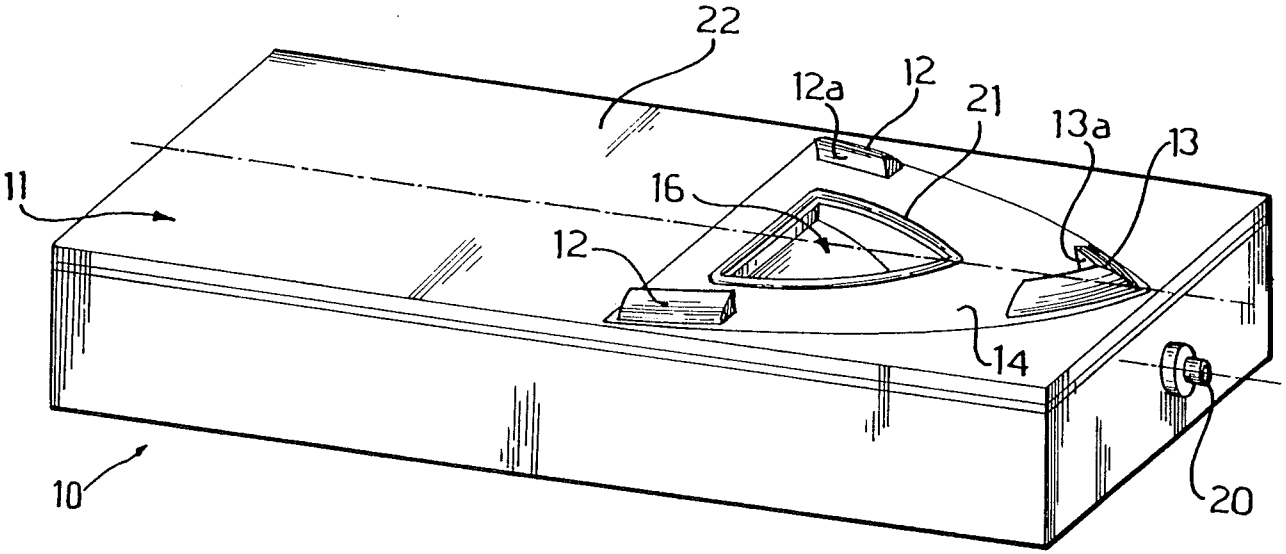
FIG. 3 is a perspective view of the apparatus of this invention wherefrom the steam jet iron has been omitted for clarity.

In the drawing figures, the numeral 1 generally designates a steam jet iron, preferably of the type incorporating valving means (not shown) for the continuous supply of water into a vaporizing chamber 2 located inside the body 3 of the iron 1.

The iron 1 is further provided with an ironing plate 4, which is heated electrically in a conventional manner and formed, at the vaporizing chamber 2, with orifices 5 for delivering the steam generated in the chamber.

The apparatus according to the invention also comprises a box type of body 10 having at the top a support stage or surface 11 for the iron 1, the latter being held removably on said surface 11 by a pair of cleats 12 adapted to engage the plate 4 sideways, and by a front cleat 13 adapted to engage the toe or nose **4*a* of said plate 4** in a manner to be described.

In particular, the cleats 12,13 are laid along the periphery of a flange 14 on the surface 11 which has substantially the same shape as the imprint of the plate 4. The sides **12*a*,13*a* of said cleats 12,13 facing the flange 14 are inclined and converge in the direction toward the center of the flange so as to press the plate 4, when engaged between the cleats 12,13**, against the flange.

The flange 14 is pierced centrally by the inlet mouth 15 of a manifold 16 preferably formed integrally with the flange itself.

The relative positioning of the flange 14, cleats 12–13, and manifold 16 is selected such that said manifold will be at a position underlying the orifices 5 in the plate 4 with the iron 1 engaged with the flange by means of the cleats.

The manifold 16 is provided with thermostat-controlled heating means, generally indicated at 17; it is connected hydraulically to a delivery conduit 18 extending through the box-like body 10 and opening on the outside thereof through a fitting 20 over which a suitable line, not shown, may be fitted for delivering steam to different outlets.

The inlet mouth 15 of the manifold 16 is surrounded by a gasket 21 forming a seal between the plate 4 and manifold 16; the seal effectiveness is enhanced by the pressure action exerted by the faces **12*a* and 13*a* of the cleats onto the plate 4** of the iron on account of their inclination.

The surface 11 unaffected by the flange 14 is faced with an insulating material 22, whilst both the flange 14 and manifold 16 are formed from a thermally conductive material, such as aluminum or its alloys.

The apparatus of this invention operates as follows: the iron 1 is first placed onto the surface 11 and slid in between the cleats 12 toward the front cleat 13 until it is securely held down on the flange 14 by the cleats 12,13 in pressure contact with the gasket 21.

On heating the iron 1 electrically, this is adjusted for a continuous supply of water into the vaporizing chamber 2. The vaporized water will then flow through the orifices 5 in the plate 4 into the manifold 16, where it may be optionally heated by the heating means 17.

The steam generated is picked up by the conduit 18 and dispensed through the line connected to the fitting 20.

The invention achieves its object and affords several additional advantages, among which the important fact that, by forming both the flange 14 and manifold 16 from a thermally conductive material, the manifold can be heated by the same heating means which act on the plate 4.

The apparatus of this invention, besides being appreciably compact, has the further advantage of relatively low power requirements, since instead of heating a large mass of water, it will gradually vaporize each time that there is a demand, the right amount of water to meet the momentary need for steam.

Furthermore, the box-like body 10 may be used, when not operated to deliver steam, as a stand for the iron when the latter is normally used for ironing purposes.

I claim:

1. A steam generating apparatus for different household application outlets, said apparatus comprising:

a steam jet iron having an ironing plate formed with steam delivery orifices, a steam manifold removably associated with said ironing plate at said orifices, sealing means interposed between said steam manifold and said ironing plate, a steam delivery conduit hydraulically connected to said steam manifold, and thermostat-controlled heating means associated with said steam manifold.

2. An apparatus according to claim 1, wherein cleats formed on said flange have sides inclining and converging in a direction toward the center of said flange.

3. An apparatus according to claim 1, wherein said steam manifold and said flange are formed from a thermally conductive material.

4. An apparatus according to claim 3, wherein a box-like body forms a support stage for said iron, said flange being formed with said stage and said stage having a thermally insulating material over its surface.

5. A device for using a steam jet iron of the type equipped with an ironing plate formed with steam delivery orifices as a steam generator for operating a range of different household outlets, said device comprising:

a box-like body forming a support stage for said iron, a flange defined by said body, a steam manifold in said flange, a steam delivery conduit in fluid communication with said steam manifold, at least three cleats located on said flange, two of said cleats being located adjacent to and on opposite sides of said steam manifold and having sides set at an inclined angle towards said flange to press said plate toward said flange and for removably holding said plate when said plate is slid across said support stage and engages said cleats and for permitting sliding away on said support stage of said plate from said cleats while said steam delivery orifices are generating steam, and sealing means on said flange encircling said steam manifold and forming a sealed passage between said plate and said manifold when said plate is pressed towards said flange by said cleats.

6. A steam generating apparatus for different household application outlets, said apparatus comprising:

a steam jet iron having an ironing plate formed with steam delivery orifices, a support stage for said iron having a steam manifold removably associated with said ironing plate at said orifices, sealing means interposed between said steam manifold and said ironing plate, holding means mounted on said support stage for removably holding said plate when said plate is slid across said support stage and engages said holding means, and for permitting sliding away on said support stage of said plate from said holding means while said steam delivery orifices are generating steam, a steam delivery conduit hydraulically connected to said steam manifold, and thermostat-controlled heating means associated with said steam manifold.

7. An apparatus according to claim 6, wherein said holding means includes cleats formed on said flange and whose sides are inclined and converge in a direction toward the center of said flange.

8. An apparatus according to claim 6, wherein thermostat-controlled heating means are associated with said steam manifold.

9. An apparatus according to claim 6, wherein said steam manifold and said flange are formed from a thermally conductive material.

10. An apparatus according to claim 9, wherein said flange is formed with said stage and said stage having a thermally insulating material over its surface other than at said flange.

* * * * *